United States Patent [19]

Wible

[11] Patent Number: 4,531,615

[45] Date of Patent: Jul. 30, 1985

[54] HIGH-VISIBILITY MAST ASSEMBLY FOR LIFT TRUCKS

[75] Inventor: John E. Wible, Painesville, Ohio

[73] Assignee: Towmotor Corporation, Mentor, Ohio

[21] Appl. No.: 433,471

[22] PCT Filed: Jun. 25, 1982

[86] PCT No.: PCT/US82/00869

§ 371 Date: Jun. 25, 1982

§ 102(e) Date: Jun. 25, 1982

[87] PCT Pub. No.: WO84/00149

PCT Pub. Date: Jan. 19, 1984

[51] Int. Cl.[3] ..... B66B 9/20

[52] U.S. Cl. ..... 187/9 E; 414/631

[58] Field of Search ..... 187/9 E, 9 R, 8.59, 187/17, 20; 414/629-631; 254/89 R, 89 H

[56] References Cited

U.S. PATENT DOCUMENTS

| | | | |
|---|---|---|---|
| 2,139,597 | 12/1938 | Martin | 187/8.59 |
| 2,670,811 | 3/1954 | Shaffer | 187/9 E |
| 3,187,842 | 6/1965 | Quayle | 187/9 E |
| 3,208,556 | 9/1965 | Shaffer | 187/9 E |
| 3,851,732 | 12/1974 | Wagner et al. | 187/9 E |
| 3,985,207 | 10/1976 | Petit | 187/8.59 |
| 4,356,891 | 11/1982 | Bartow | 414/631 |
| 4,392,554 | 7/1983 | Russey | 187/9 E |

FOREIGN PATENT DOCUMENTS

| | | | |
|---|---|---|---|
| 825372 | 3/1938 | France | 187/8.59 |
| 372573 | 5/1932 | United Kingdom | 187/8.59 |
| 764982 | 1/1957 | United Kingdom | 187/9 E |
| 2045208 | 10/1980 | United Kingdom | 187/9 E |
| 2046704 | 11/1980 | United Kingdom | 187/9 E |

*Primary Examiner*—Joseph J. Rolla
*Assistant Examiner*—Kenneth Noland
*Attorney, Agent, or Firm*—Phillips, Moore, Lempio & Finley

[57] ABSTRACT

The mast assembly for a standard lift truck includes a lift system having a centrally-disposed hydraulic cylinder and a pair of chains mounted on the cylinder to selectively raise and lower a movable upright assembly on a fixed upright assembly and a carriage on the movable upright assembly. This arrangement impairs the forward field of vision of the operator. The mast assembly (11) of this invention overcomes this problem by securing opposite ends of a chain (17) to laterally space uprights (13,14) of a fixed upright assembly (12), entraining the chain (17) under at least one chain guide (20) mounted on a lower end of a movable upright assembly (15), and engaging the chain with a hydraulic cylinder (22) to selectively raise and lower the movable upright assembly (15) on the fixed upright assembly (12). The preferred embodiment of this invention also includes a carriage (25) slidably mounted on the movable upright assembly (15) and movable in response to movement of the movable upright assembly (15) on the fixed upright assembly (12).

14 Claims, 5 Drawing Figures

HIGH-VISIBILITY MAST ASSEMBLY FOR LIFT TRUCKS

TECHNICAL FIELD

This invention relates generally to a mast assembly for lift trucks and more particularly to a lift system for selectively raising and lowering a movable upright on a fixed upright of the mast assembly.

BACKGROUND ART

One type of conventional lift truck employs a lift system including a cylinder and a pair of chains mounted centrally of a mast assembly thereof. Such disposition of the cylinder and chains tends to impair the forward visibility of the truck's operator. Various solutions have been proposed to solve this problem, such as by positioning a lift chain directly behind the cylinder and/or by displacing the cylinder laterally and adjacent to an upright channel of the fixed upright of the mast assembly.

Prior art solutions of the latter type have not fully solved the visibility problem and in many designs tend to increase the overall complexity and number of component parts employed in the mast assembly. In addition, such designs give rise to load balancing and sequencing problems and do not afford the desired protection to operating components thereof.

The present invention is directed to overcoming one or more of the problems as set forth above.

DISCLOSURE OF INVENTION

In one aspect of this invention, a lift truck mast assembly comprises a fixed upright assembly having laterally-spaced uprights adapted for mounting on a lift truck, a moveable upright assembly mounted on the fixed upright assembly, at least one chain secured at opposite end portions to the fixed upright assembly, a pair of laterally spaced chain guides mounted on a lower end portion of the moveable upright assembly and having the chain entrained thereunder to form a pair of vertically disposed and laterally-spaced chain portions, and actuating means engaging the chain between one end of the chain and the chain guides for selectively raising the moveable upright assembly on the fixed upright assembly in response to extension of the actuating means and for lowering the moveable upright assembly on the fixed upright assembly in response to retraction of the actuating means.

In another aspect of this invention, a lift truck has a mast assembly mounted forwardly theron which comprises a fixed upright assembly having laterally-spaced first and second uprights, a moveable upright assembly slideably mounted on the uprights, a pair of laterally-spaced sheaves mounted on a lower end portion of the moveable upright assembly, a fluid cylinder having a lower end portion attached to the fixed upright assembly and an upper end portion attached to a sheave, and a chain having a first end portion attached to the first upright and a second end portion attached at least closely adjacent to the second upright. The chain is sequentially entrained from its first end portion over the sheave attached on the cylinder and under the sheaves mounted on the moveable upright assembly to raise the moveable upright assembly on the fixed upright assembly in response to extension of the fluid cylinder and to lower the moveable upright assembly in response to retraction of the fluid cylinder.

The improved mast assembly of this invention will provide the operator of a lift truck or other type of industrial vehicle with a high degree of forward visibility through the mast assembly. In addition, the lift system for the mast assembly is composed of a minimum number of well-protected component parts, including the highly reliable single stage single-acting hydraulic cylinder with flow control. The lift system also avoids load balancing and sequencing problems normally encountered with conventional dual cylinder or offset cylinder designs.

BRIEF DESCRIPTION OF THE DRAWINGS

Other objects and advantages of this invention will become apparent from the following description and accompanying drawings wherein.

BEST MODE OF CARRYING OUT THE INVENTION

Figure 1:
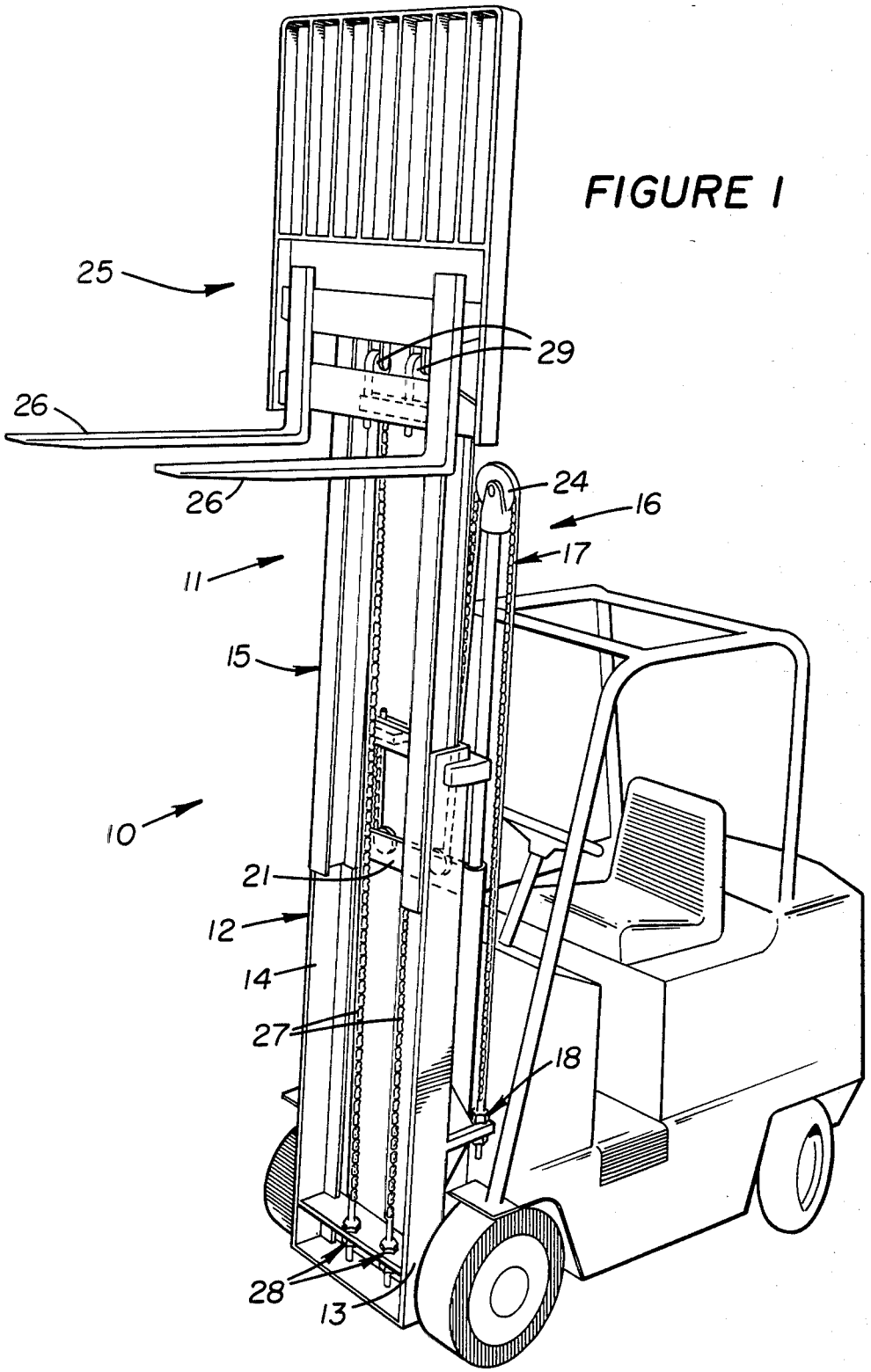
FIG. 1 illustrates a lift truck employing a mast assembly embodiment of the present invention thereon, with the mast assembly shown in its extended condition of operation.

FIG. 1 illustrates a lift truck 10 having a mast assembly 11 mounted forwardly thereon in a conventional manner. The mast assembly includes an outer or fixed upright assembly 12, mounted on the frame of the truck, having a pair of laterally-spaced uprights 13, 14 suitably secured together by transverse tie bars in a conventional manner. An inner or movable upright assembly 15 is slidably mounted on the fixed upright assembly to be selectively raised and lowered thereon by a lift system 16.

As described above, the lift systems for many conventional mast assemblies include a hydraulic cylinder disposed centrally between uprights, corresponding to uprights 13, 14 of mast assembly 11. In addition, a pair of chains are mounted on either side of the cylinder, with the cylinder and chains thus tending to impair the visibility of the operator of the lift truck. Lift system 16 of this invention substantially solves this visibility problem, as well as providing the additional desiderata discussed above.

Referring to FIGS. 2–6, lift system 16 includes at least one lift chain 17 having a first end secured to upright 13 by an anchor and bracket assembly 18 and a second end secured to channel 14 by a similar assembly 19. A pair of laterally-spaced chain guides or sheaves 20 are rotatably mounted on a cross member 21, secured on a lower end portion of movable upright assembly 15 and have chain 17 entrained thereunder.

A single stage single-acting hydraulic cylinder 22 has its lower or head end suitably mounted at 23 on a lower end of fixed upright assembly 12. The upper or rod end of the cylinder has a chain guide or sheave 24 rotatably mounted thereon. The sheave engages chain 17 between bracket 18 and the leftmost sheave 20, as viewed in FIG. 2. The cylinder is suitably connected in a conventional operator-controlled fluid circuit to be selectively extended and retracted to move upright assembly 15 on upright assembly 12, as shown in FIGS. 2 and 4, respectively.

Figure 2:
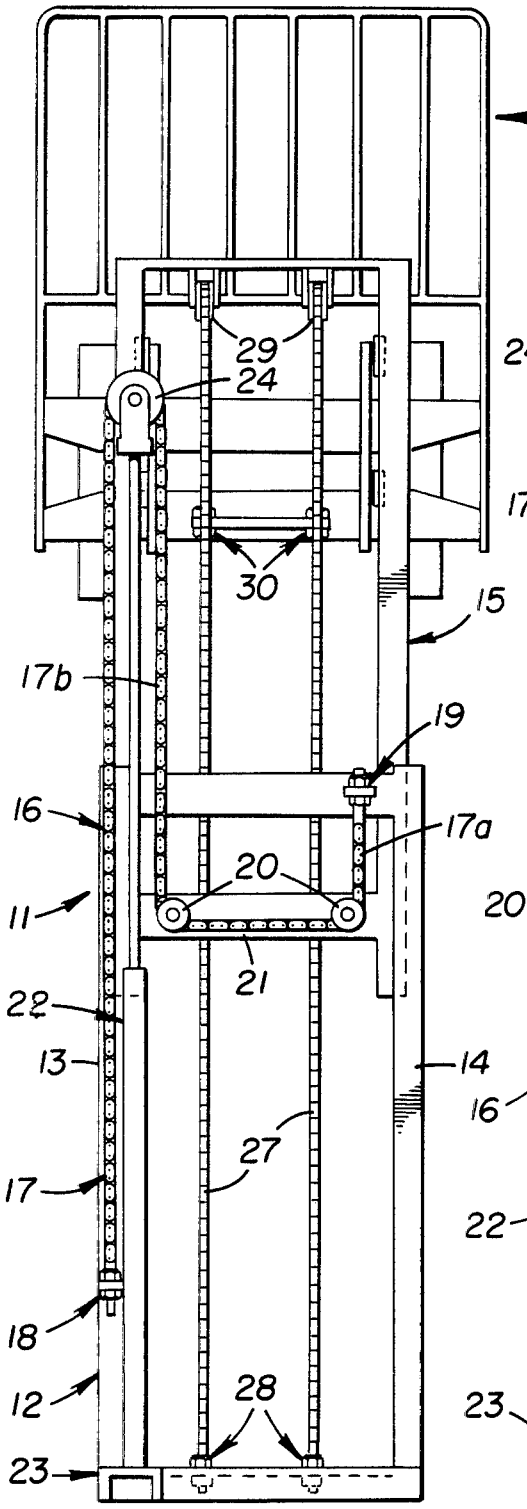
FIG. 2 is a rear elevational view of the mast assembly.
Figure 4:
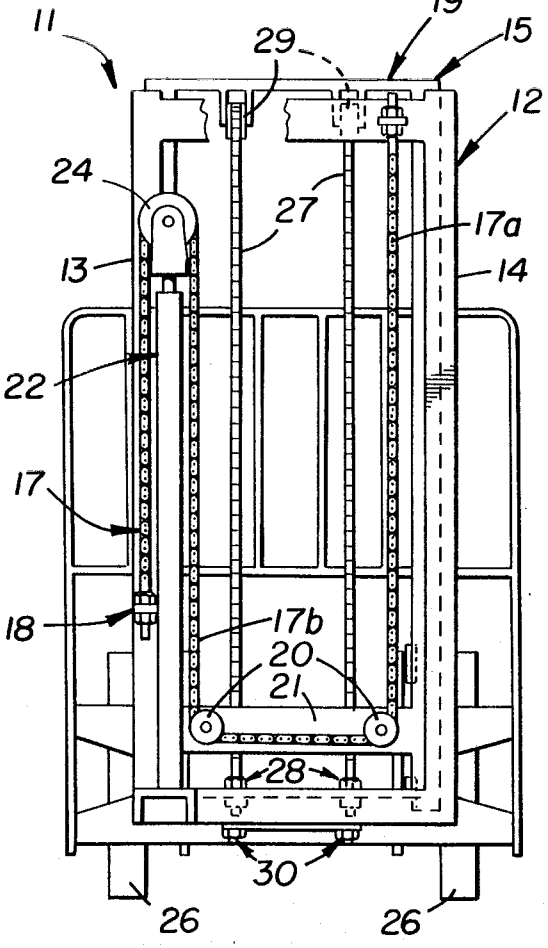

It should be noted in FIGS. 2 and 4 that the offset disposition of cylinder 22 alongside upright 13 and vertically-disposed and laterally spaced chain portions 17*a*, 17*b* of chain 17, extending upwardly from sheaves 20 adjacent to uprights 13, 14, provide a substantially unobstructed forward view through the mast assembly from the operator's station of the lift truck. In addition, the positioning of sheaves 20 at equal distances from the outer sides of movable upright assembly 15 and uprights 13, 14 will provide a balanced lift system imposing identical tensions in chain portion 17*a*, 17*b* and equal reaction forces on sheaves 20. Thus, any loads imposed on the movable upright assembly will be balanced to ensure efficient operation and the imposition of minimal torsional loads on the mast assembly, including those imposed on the standard rollers (not shown) slidably mounting the movable upright assembly on the fixed upright assembly.

Any suitable working tool can be mounted on movable upright assembly 15, such as a conventional carriage 25 having standard forks 26 attached thereon, as illustrated in FIG. 1. Alternatively, the work tool could comprise a carton, bale, paper roll, barrel, or general purpose clamp, or any other standard tool adapted for use with a mast assembly.

Carriage 25 is slidably mounted on movable upright assembly 15 in a conventional manner, and is elevationally moved thereon by a pair of chains 27, as shown in FIGS. 2 and 4. As shown, a first end of each chain is secured to an anchor and bracket assembly 28, positioned at a lower end portion of fixed upright assembly 12. The chain is entrained over a respective sheave 29, rotatably mounted on an upper end of movable upright assembly 15, with the second end of the chain being secured to an anchor and bracket assembly 30, positioned on a lower backside of carriage 25.

Figure 3:
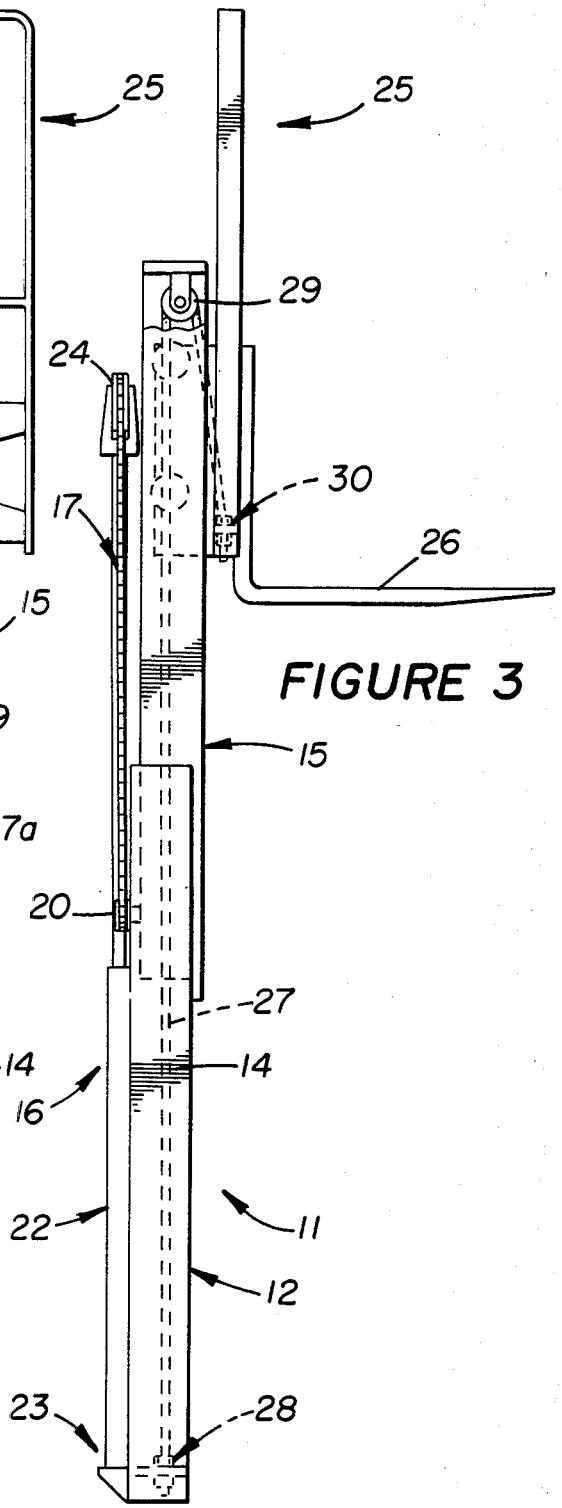
FIG. 3 is a side elevational view of the extended mast assembly.

Thus, it can be seen in FIGS. 2 and 3 that upon extension of cylinder 22 to raise movable upright assembly 15 on fixed upright assembly 12, carriage 25 will simultaneously move upwardly on the movable upright assembly, i.e., raising and lowering movements of the carriage are responsive to raising and lowering movements of the movable upright assembly. The ratio of movements between the fixed and movable upright assemblies and the movable upright assembly and the carriage, as well as the speeds of movement thereof, will, of course, depend on various design parameters, such as the lengths of the chains, the positioning of brackets 18, 19, and 28, the positioning and extension capabilities of cylinder 22, etc.

INDUSTRIAL APPLICABILITY

Mast assembly 11 finds particular application to industrial trucks, such as lift truck 10, as illustrated in FIG. 1. The lift truck is normally equipped with a standard carriage 25 having lift forks 26 attached thereon, but may have other types of standard work tools mounted thereon, as discussed above.

Figure 5:
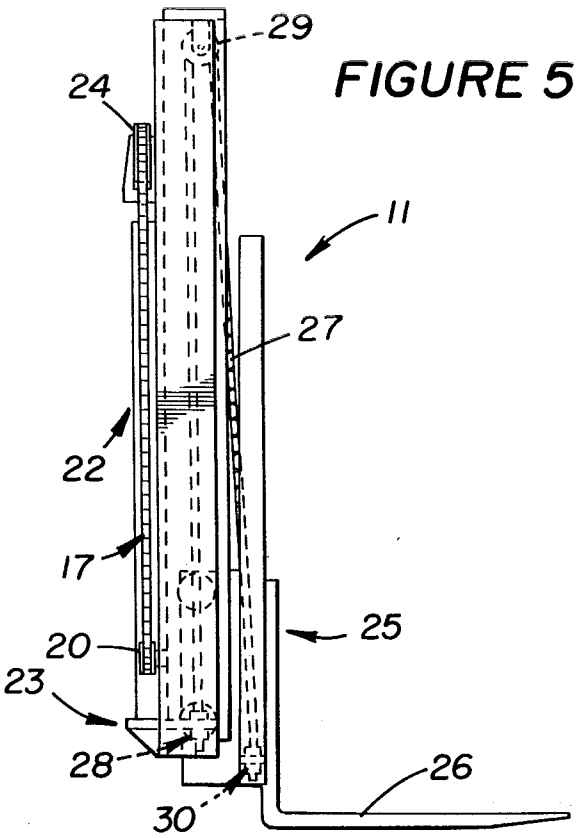
FIGS. 4 and 5 are front and side elevational views of the mast assembly, but showing it in its retracted condition of operation.

When the operator engages and supports a load on forks 26 with cylinder 22 being fully retracted, as shown in FIGS. 4 and 5, he is enabled to extend the cylinder to raise the load and transport it to a remote location. During transportion of the load by the lift truck, the operator is provided with a substantially unobstructed forward field of vision to aid in maneuvering the truck. Carriage chains 27 should be displaced laterally away from each other as far as practicable, depending on the lift truck design under consideration.

During lifting and transport of a load on forks 26, reaction forces imposed on sheaves 20 will be substantially identical, as well as the tensions in vertical chain portions 17*a*, 17*b*. The load will thus be balanced to aid the operator in controlling the truck. Various components of the mast assembly, including the rollers (not shown) slidably mounting movable upright assembly 15 on fixed upright assembly 12, will remain in a substantially stress-free condition of operation.

It should be understood that lift system 16 could be duplicated to increase the lifting capabilities and the overall structural integrity of the mast assembly, i.e., the dual system could include a pair of chains 17 disposed in side-by-side (front-to-back) relationship and engaged and actuated by a single common cylinder 22 or by a separate cylinder for each chain and hydraulically interconnected for simultaneous actuation.

Other aspects, objects, and advantages of this invention can be obtained from a study of the drawings, the description, and the appended claims.

I claim:

1. A lift truck (10) mast assembly (11) comprising a fixed upright assembly (12) having laterally-spaced uprights (13, 14) adapted for mounting on a lift truck (10), a moveable upright assembly (15) sideably mounted on said fixed upright assembly (12), at least one chain (17) secured at opposite end portions thereof to said fixed upright assembly (12), a pair of laterally spaced chain guides (20) mounted on a lower end portion of said moveable upright assembly (15) and having said chain (17) entrained thereunder to form a pair of vertically disposed and laterally-spaced chain portions (17*a*, 17*b*), and actuating means (22) engaging said chain (17) between one end of said chain (17) and said chain guides (20) for selectively raising said moveable upright assembly (15) on said fixed upright assembly (12) in response to extension of said actuating means (22) and for lowering said moveable upright assembly (15) on said fixed upright assembly (12) in response to retraction of said actuating means (22).

2. The mast assembly of claim 1 wherein each of said chain portions (17*a*,17*b*) are each disposed closely adjacent to a respective one of said uprights (13,14).

3. The mast assembly of claim 1 further including a carriage (25) slidably mounted on said movable upright assembly (15) and means (27) for moving said carriage (25) on said movable upright assembly (15) in response to movement of said movable upright assembly (15) on said fixed upright assembly (12).

4. The mast assembly of claim 3 wherein said last-mentioned means (27) includes at least one chain having a first end portion attached to said fixed upright assembly (12) and a second end portion attached to said carriage (25), a chain guide (29) mounted on said movable upright assembly (15) and having said last-mentioned chain (17) entrained thereover.

5. The mast assembly of claim 4 wherein said last-mentioned means (27) includes a pair of laterally-spaced chains each having opposite end portions thereof connected to said fixed upright assembly (12) and to said carriage (25).

6. The mast assembly of claim 5 wherein each of said last-mentioned chains (17) is positioned closely adjacent to a respective one of said uprights (13,14).

7. A lift truck (10) having a mast assembly (11) mounted forwardly thereon, said mast assembly (11) comprising a fixed upright assembly (12) having laterally-spaced first and second upright (13, 14), a moveable upright assembly (15) slideably mounted on said uprights (13, 14).

a pair of laterally-spaced sheaves (20) mounted on a lower end portion of said moveable upright assembly (15), a fluid cylinder (22) having a lower end portion thereof attached to said fixed upright assembly (12) and an upper end portion thereof attached to a sheave (24), and a chain (17) having a first end portion thereof attached to said first upright (13) and a second end portion thereof attached to said second upright (14), said chain (17) sequentially entrained from its first end portion over the sheave (24) attached on the upper end portion of said cylinder (22) and under the sheaves (29) mounted on the lower end portion of said moveable upright assembly (15) to raise said moveable upright assembly (15) on said fixed upright assembly (12) in response to extension of said fluid cylinder (22) and to lower said moveable upright assembly (15) on said fixed upright assembly (12) in response to retraction of said fluid cylinder (22).

8. The lift truck (10) of claim 7 wherein said chain (17) includes a first vertically disposed chain portion (17*a*) extending downwardly from the sheave (24) attached on the upper end portion of said cylinder (22) to a first one of the sheaves (20) mounted on the lower end portion of said movable upright assembly (15) and a second chain portion (17*b*) extending upwardly from the second one of the sheaves (20) mounted on the lower end portion of said movable upright assembly (15) to the point of attachment of the second end portion of said chain (17) to said second upright (14).

9. The lift truck (10) of claim 8 wherein said first and second chain portions (17*a*,17*b*) are substantially parallel and are positioned closely adjacent to said first and second uprights (13,14), respectively.

10. The lift truck of claim 7 wherein fluid cylinder (22) is disposed closely adjacent to and in parallel relationship to one of said uprights (13,14).

11. The lift truck of claim 7 further including a carriage (25) slidably mounted on said movable upright assembly (15) and means (27) for moving said carriage (25) on said movable upright assembly (15) in response to movement of said movable upright assembly (15) on said fixed upright assembly (12).

12. The lift truck of claim 11 wherein said last-mentioned means (27) includes at least one chain having a first end portion attached to said fixed upright assembly (12) and a second end portion attached to said carriage (25), a chain guide (29) mounted on said movable upright assembly (15) and having said last-mentioned chain (17) entrained thereover.

13. The lift truck of claim 12 wherein said last-mentioned means (27) includes a pair of laterallyspaced chains each having opposite ends thereof connected to said fixed upright assembly (12) and to said carriage (25).

14. The lift truck of claim 13 wherein each of said last-mentioned chains (17) is positioned closely adjacent to a respective one of said uprights (13,14).

* * * * *